US008191495B2

(12) United States Patent
Gratz

(10) Patent No.: US 8,191,495 B2
(45) Date of Patent: Jun. 5, 2012

(54) TRANSOM REINFORCEMENT GRID

(75) Inventor: Christopher M. Gratz, Port St. Lucie, FL (US)

(73) Assignee: S2 Yachts Inc., Holland, MI (US)

( * ) Notice: Subject to any disclaimer, the term of this patent is extended or adjusted under 35 U.S.C. 154(b) by 168 days.

(21) Appl. No.: 12/496,734

(22) Filed: Jul. 2, 2009

(65) Prior Publication Data

US 2010/0006017 A1 Jan. 14, 2010

Related U.S. Application Data

(60) Provisional application No. 61/079,569, filed on Jul. 10, 2008.

(51) Int. Cl.
*B63B 3/14* (2006.01)

(52) U.S. Cl. ..... 114/355; 114/357; 440/111

(58) Field of Classification Search ..... 114/343, 114/355, 357, 364, 56.1; 440/111
See application file for complete search history.

(56) References Cited

U.S. PATENT DOCUMENTS

| | | | | |
|---|---|---|---|---|
| 2,585,344 | A * | 2/1952 | Plaziak | 114/356 |
| 4,892,054 | A * | 1/1990 | Davidson | 114/357 |
| 4,895,095 | A * | 1/1990 | Potter, Jr. | 114/343 |
| 5,211,592 | A * | 5/1993 | Alkema | 440/111 |
| 5,277,145 | A * | 1/1994 | Hordis | 114/357 |
| 5,293,832 | A * | 3/1994 | Potter, Jr. | 114/364 |
| 5,787,836 | A * | 8/1998 | Blaisdell et al. | 114/357 |
| 6,182,591 | B1 * | 2/2001 | Whitesides et al. | 114/355 |
| 6,415,728 | B1 * | 7/2002 | Maeda et al. | 114/357 |
| 6,948,444 | B2 * | 9/2005 | Stinson | 114/357 |

* cited by examiner

*Primary Examiner* — Lars A Olson
(74) *Attorney, Agent, or Firm* — Price Heneveld LLP

(57) ABSTRACT

A reinforcement grid for a vessel includes a plurality of spaced-apart, generally vertically extending walls coupled by lateral floor sections and lateral walls which are coupled to stringers, the transom, and the bottom of the vessel hull to strengthen the transom, thereby allowing a greater number of higher horsepower engines to be mounted to the vessel.

22 Claims, 6 Drawing Sheets

TRANSOM REINFORCEMENT GRID

CROSS-REFERENCE TO RELATED APPLICATIONS

This application claims priority under 35 U.S.C. §119(e) and the benefit of U.S. Provisional Application No. 61/079,569 entitled TRANSOM REINFORCEMENT GRID, filed on Jul. 10, 2008, by Christopher M. Gratz, the entire disclosure of which is incorporated herein by reference.

BACKGROUND OF THE INVENTION

The present invention relates to a reinforcement grid for the transom of a vessel and a vessel with such a feature.

Frequently, open-style fishing boats are powered by one or two outboard engines mounted to the transom. For certain outboard engine combinations and in some hull designs, it is not possible to terminate a longitudinal stringer in the stringer grid on the centerline of each engine. However, terminating a longitudinal stringer at each engine center is desirable since it restrains the deflection on the transom laminate and transfers the load imparted by the outboard engines into the vessel's structural grid. As open-style boats become larger, it has become desirable to increase the engine size as well as the number of engines. When, for example, three large horsepower engines are mounted to the transom of a vessel, the load forces placed on the transom are greatly increased. Coupling the transom of the hull to a conventional stringer system and not restraining the transom panel at each outboard engine can lead to undesirable deflections, stress, and fatigue of the laminate.

Thus, there is a need to improve the structural integrity of the transom of boats employing multiple engines with increased horsepower. This will allow the desired performance of the boats while maintaining their structural integrity.

SUMMARY OF THE INVENTION

The system of the present invention improves the rigidity of the transom to hull and stringer interface by providing a transom reinforcement grid made of fiberglass which restrains the transom panel of the hull of the vessel at each outboard engine location. The reinforcing grid of the present invention comprises a three-dimensional box-like structure having spaced-apart longitudinal side walls coupled by floor sections and front and rear end walls which conform to the stringers of a given vessel design. The grid couples the stringers to the transom and hull of a vessel to provide lateral and longitudinal support for the transom.

The reinforcement grid can be molded of fiberglass material and have its exterior, visible surfaces gel-coated. The grid is formed to fit a particular boat design and is bonded to existing boats utilizing a bonding adhesive, such as methacrylate. The reinforcement grid of the present invention, therefore, comprises a plurality of spaced-apart, generally longitudinally and vertically extending walls coupled by floor sections and walls which extend laterally in a boat and which adjoin and are coupled to stringers, the transom, and the inner bottom surface of the vessel hull to strengthen the transom, thereby allowing a greater number of higher horsepower engines to be mounted to the transom of the vessel.

These and other features, objects and advantages of the present invention will become apparent upon reading the following description thereof together with reference to the accompanying drawings.

DETAILED DESCRIPTION OF THE PREFERRED EMBODIMENT

As used herein, the term "longitudinally", with respect to the direction of orientation of the grid in a vessel, pertains to the fore and aft direction of the vessel; "transversely," "outwardly" or "laterally", as used herein, refers to port to starboard directions of the vessel, while "vertically extending" has its normal bottom-to-top meaning. Vessel and boat may be used interchangeably to refer generally to a pleasure boat or yacht made of a resinous or other material.

Figure 1:
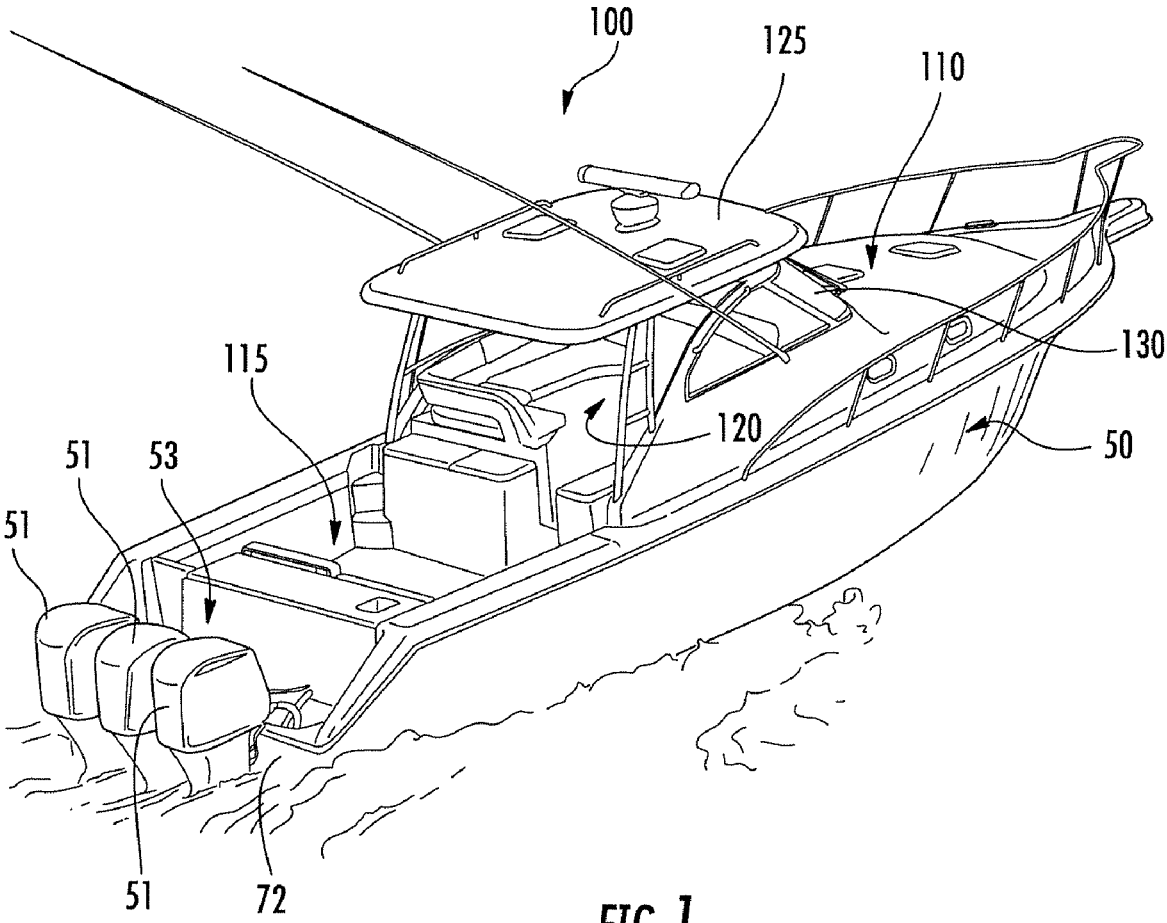
FIG. 1 is a rear perspective view of a vessel embodying the present invention.
Figure 2:
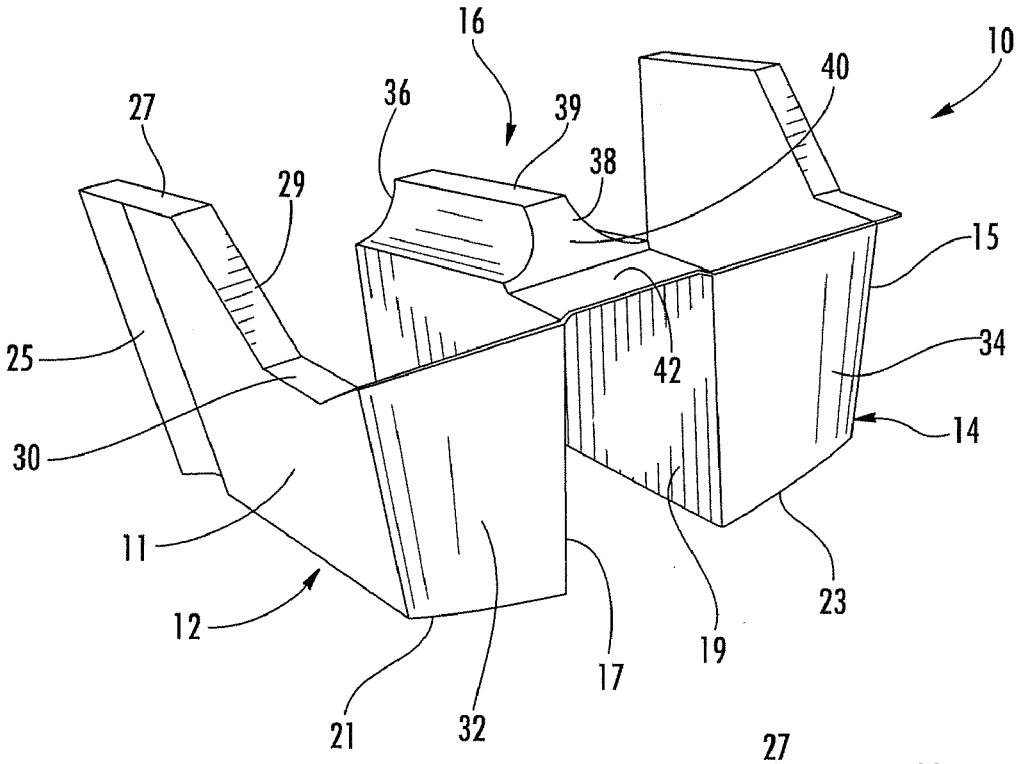
FIG. 2 is a perspective view of a reinforcement grid of the present invention.
Figure 3:
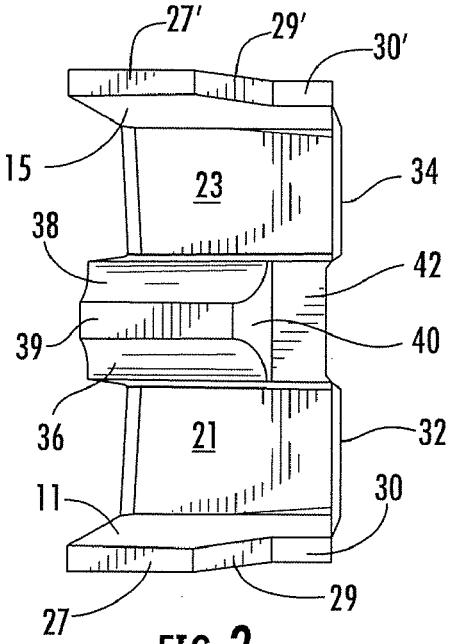
FIG. 3 is a top plan view of the reinforcement grid shown in FIG. 2.

Referring initially to FIG. 1, there is shown an open style boat or vessel 100 which has a hull 50 and topside 110 which encloses the cabin and living area below. The vessel also includes a cockpit area 115 and bridge deck 120 enclosed by a hardtop 125 and windshield 130. The hull 50 extends aft to a motor well area 53 and transom 72. The vessel 100 is a high performance fishing boat that is powered by three 350 HP outboard engines 51 and has the improved structure for reinforcing the transom area of the hull of the present invention to accommodate the combined over 1000 HP and weight of engines 51. The boat 100 illustrated in FIG. 1 is a Pursuit® 375 Offshore using three Yamaha 350 HP engines. In order to maintain the structural integrity of the hull which includes a stringer system for strength, and utilize such relatively large engines, the reinforcement grid of the present invention has been incorporated into the hull 50 and is now described.

Figure 4:
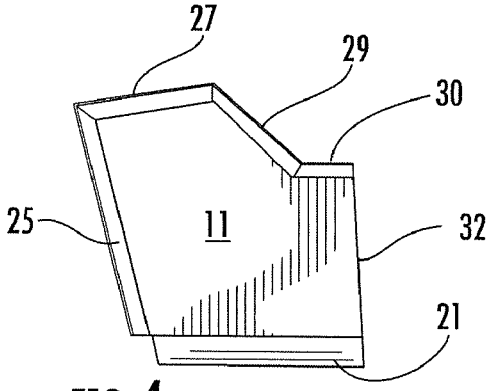
FIG. 4 is a left side elevational view of the grid shown in FIG. 2.
Figure 5:
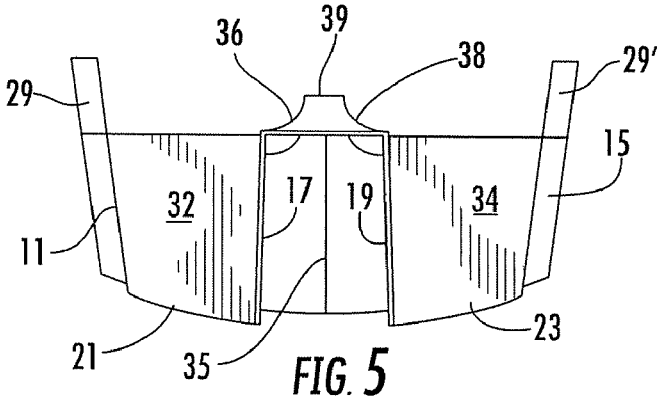
FIG. 5 is a front elevational view of the structure shown in FIG. 2.
Figure 12:
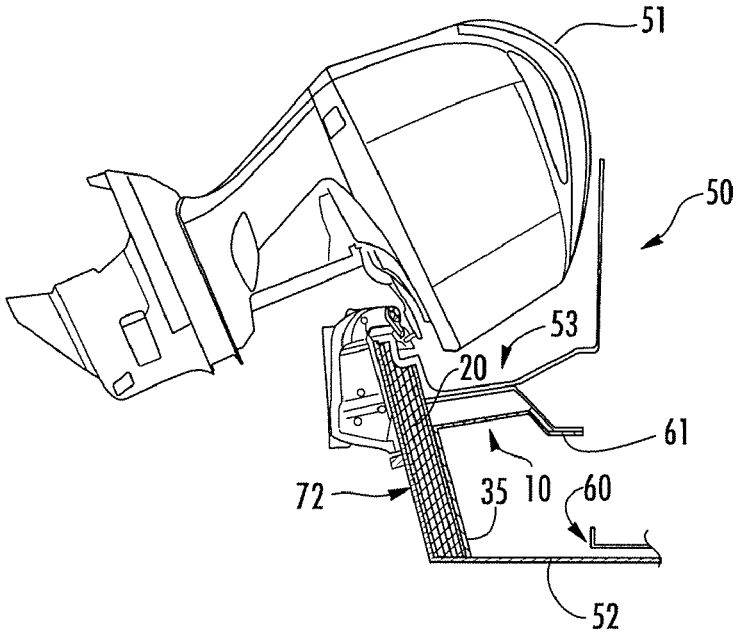
FIG. 12 is a fragmentary vertical cross-sectional view through the centerline of the vessel.

As seen in FIGS. 2-5, the reinforcement grid 10 of the present invention comprises an integrally molded, somewhat box-like structure having, in the embodiment shown, two sections 12 and 14 joined by a bridge section 16. The grid includes outer longitudinally and vertically extending side walls 11 and 15 and spaced-apart inner longitudinally and vertically extending inner side walls 17 and 19. Floors 21 and 23 extend transversely between walls 11, 17 and 15, 19 at their lower end. The outer side walls 11 and 15 each terminate in an inclined laterally outwardly extending flange 25 (FIGS. 9 and 10), which is angled, as seen in FIG. 4, to conform to the angle of the transom 72 to the hull 50 of a vessel 100 (FIGS. 1 and 12). The side walls 11 and 15 also include a top laterally outwardly extending flange 27 and a forward outwardly and downwardly inclined flange 29 terminating in an outwardly generally horizontally extending flange 30. Front walls 32 and 34 integrally tie together the side walls 11, 17 and 15, 19 with floors 21 and 23, respectively. The bridge section 16 includes a rear wall 35 which, as seen in FIGS. 5 and 7-10, is integrally molded with side walls 17 and 19 and has curvilinear side walls 36 and 38 which extend upwardly and terminate in a top wall 39. Walls 36 and 38 are coupled at the forward end by an inclined wall 40 integrally coupled to horizontal forwardly extending section 42, which is coupled to side walls 17 and 19 of the grid 10. The outer side wall 15 likewise includes laterally outwardly extending flanges 27', 29', and 30'.

The insert grid 10 of the present invention is bonded to the stringers, the vessel bottom, and the transom to tie them together below the motor well area 53 (FIGS. 1 and 12) without interfering with the mounting of the motors 51 to the transom 72. The geometry of the particular grid will vary depending upon the vessel into which it is mounted. The preferred embodiment shown herein is shaped to fit within a Pursuit® 375 Offshore vessel 100 as seen in FIG. 1, which will accommodate three 350 horsepower outboard engines 51 (FIGS. 1 and 12) with the reinforcing grid 10 as disclosed. The grid walls have a nominal thickness of from about 0.329 inches to about 0.374 inches, in one embodiment, and once bonded to the hull of the vessel 100 provides increased rigidity and strength to the transom area of the vessel.

Figure 6:
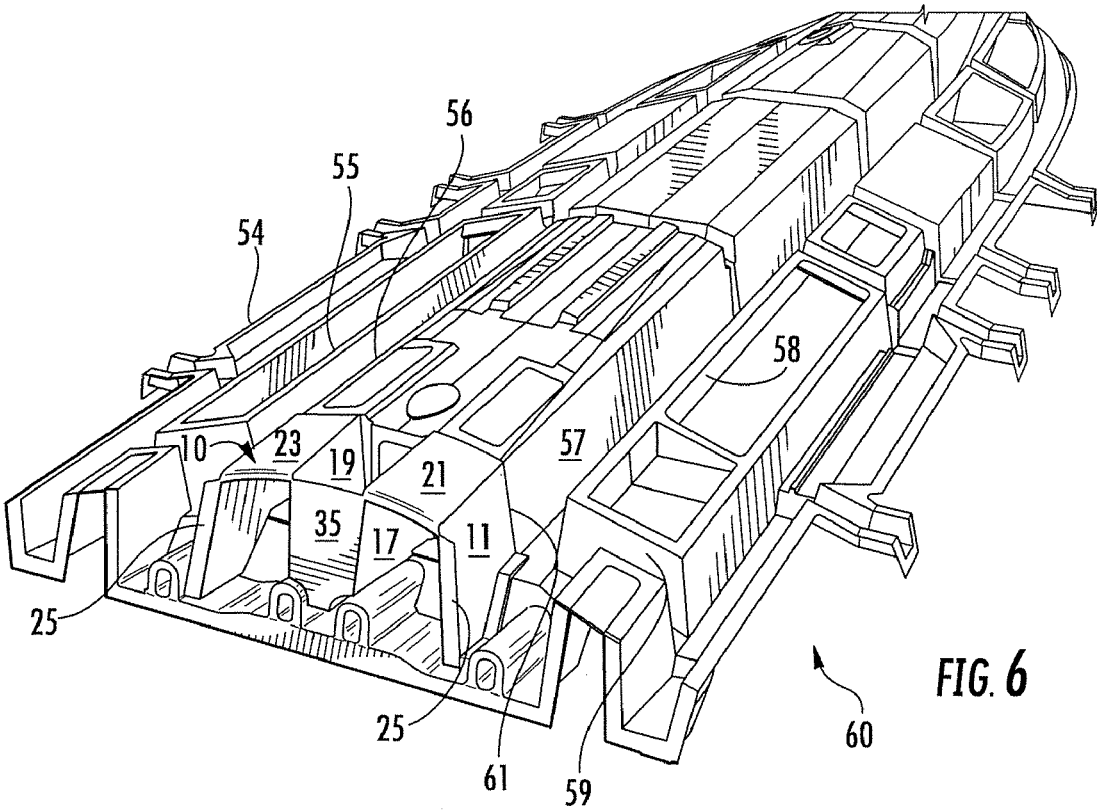
FIG. 6 is a rear perspective view of the stringer system of a vessel, showing the reinforcement grid installed therein.
Figure 7:
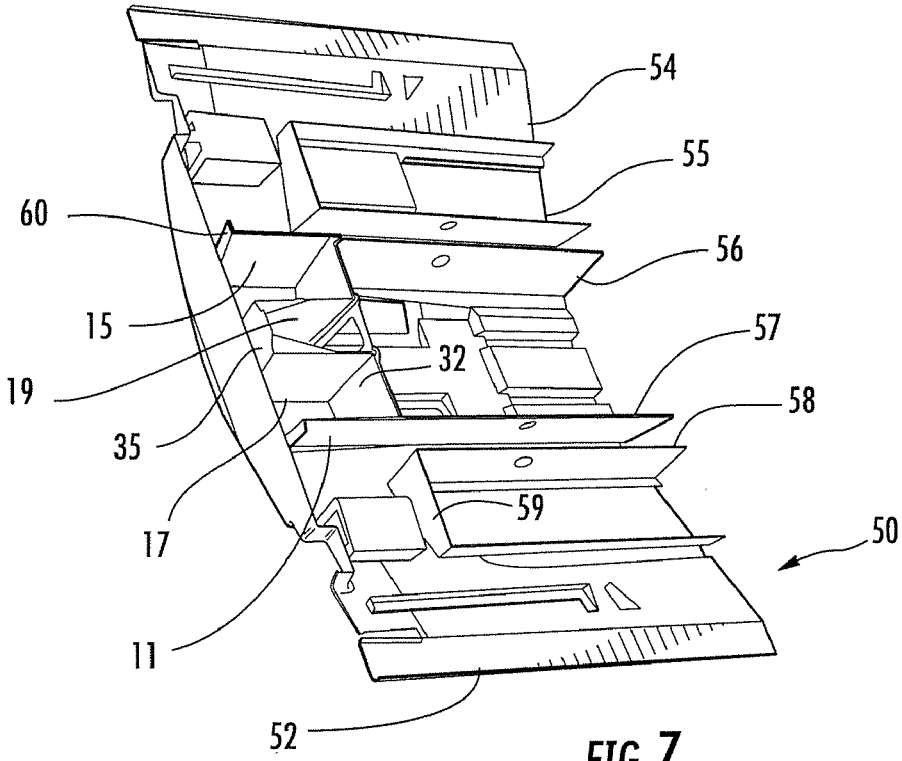
FIG. 7 is an upper fragmentary, rear perspective view of a vessel hull and stringer system, showing the placement of the reinforcement grid therein.
Figure 8:
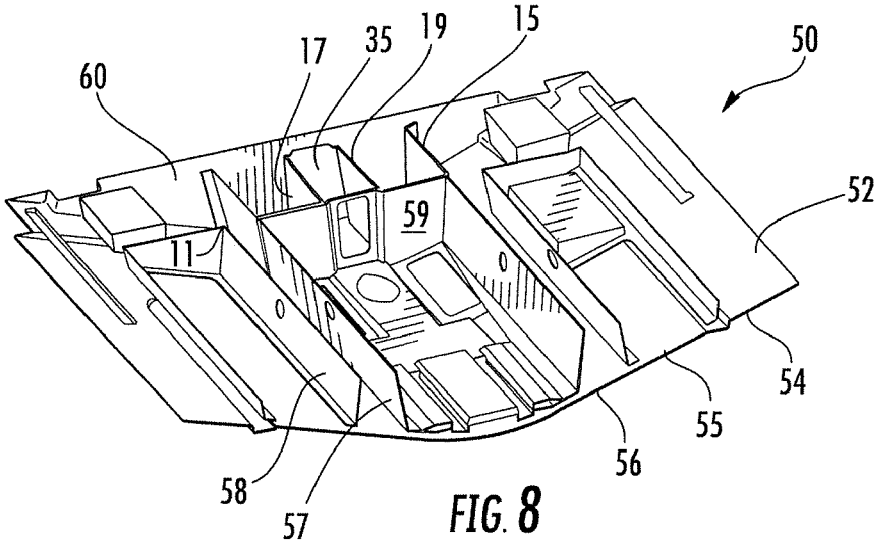
FIG. 8 is an upper front perspective view of a vessel hull and stringer system showing the reinforcement grid mounted therein.
Figure 9:
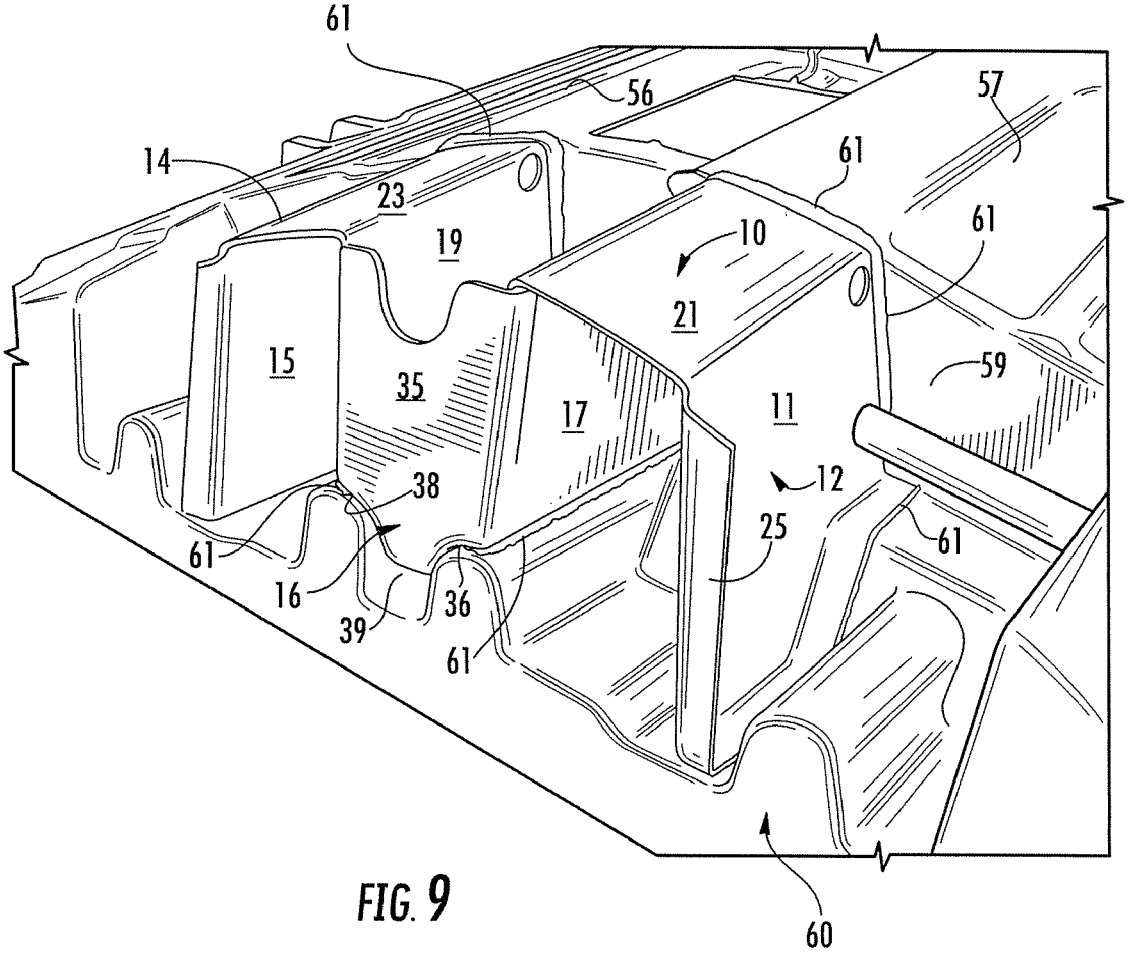
FIG. 9 is a rear port side fragmentary perspective view of the bottom of the grid insert and stringer assembly prior to mounting into the vessel hull.
Figure 10:
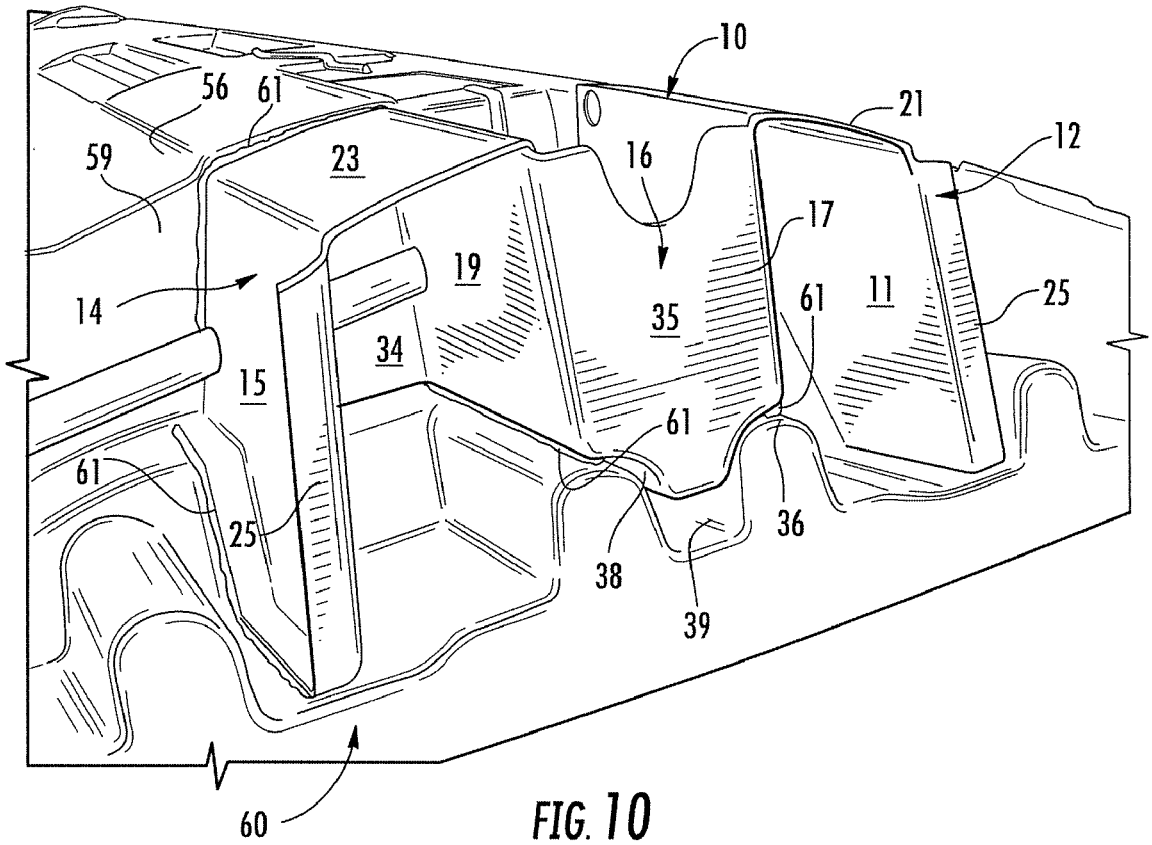
FIG. 10 is a rear starboard side fragmentary perspective view of the bottom of the grid insert and stringer assembly prior to mounting into the vessel hull.
Figure 11:
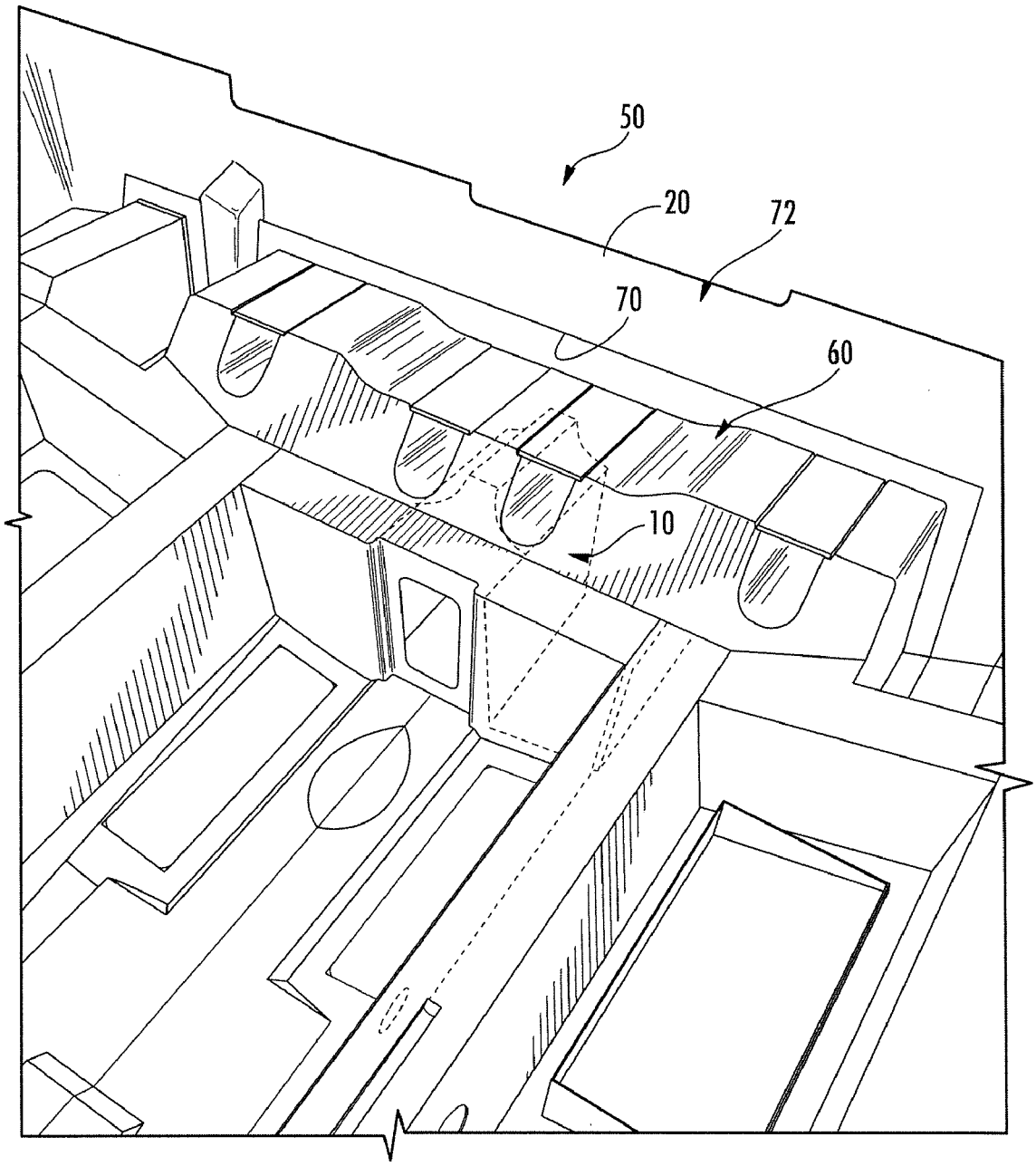
FIG. 11 is a fragmentary upper front perspective view of the grid insert mounted within the hull of a vessel.

Reinforcement grid 10 is integrally molded of fiberglass in a conventional manner and is shaped to fit within the stringers of a given vessel design, as illustrated in FIGS. 6-10. As seen in FIGS. 9 and 10, the fiberglass reinforcement grid has gel-coated surfaces, including walls 11, 15 and floors 21, 23, which are molded in a mold in a conventional manner. The outer surfaces of floors 21 and 23 are bonded to the hull bottom 52 (FIGS. 7, 8 and 12) of vessel hull 50, which includes a stringer system including longitudinally extending stringers 56 and 57, as well as the usual laterally extending cross struts 59 defining a stringer assembly 60, as seen in FIG. 6. The reinforcement grid 10 fits between the ends of stringers 55-58 with the front walls 32 and 34 bonded to the lateral stringer 59 utilizing bonding adhesives, such as methacrylate 61, as illustrated in FIGS. 6, 9, 10 and 12. The flanges 27, 29, 30, 27', 29', and 30' likewise are bonded to the stringer assembly 60, as best seen in FIGS. 6, 9 and 10, utilizing methacrylate. Rear flanges 25 and wall 35 are bonded to the laminate 20 of the transom 72 of vessel hull 50, as illustrated in FIGS. 10 and 11.

The reinforcing grid will be configured to fit the stringer system, the hull and the transom configuration of a particular vessel into which it is mounted and can be secured to the structure of the vessel by either suitable bonding agents, fasteners or other conventional means typically employed for securing structural components of a vessel. The invention likewise can be used to reinforce the transom area of any vessel, including those which have inboard/outdrive systems or inboard engines with conventional propeller shafts.

It will become apparent those skilled in the art that various modifications to the preferred embodiment of the invention as described herein can be made without departing from the spirit or scope of the invention as defined by the appended claims.

The invention claimed is:

1. A transom reinforcement grid for a vessel having a hull with a bottom, a transom, a motor well forward of the transom, and at least one stringer, said grid comprising:

a reinforcement structure having a plurality of spaced-apart, longitudinally extending walls joined by laterally extending walls and floor sections to provide a reinforcement grid which is shaped with a longitudinal length to fit only in the area of the motor well and be bonded to each of an existing stringer and a bottom of a vessel in the area of said motor well, said reinforcing structure housing including aft facing flanges which are bonded directly to the vessel transom for reinforcing the transom of a vessel.

2. A transom reinforcement grid for a vessel having a hull with a bottom, a transom, a motor well forward of the transom, and at least one stringer, said grid comprising:

a reinforcement structure having a plurality of spaced-apart, longitudinally extending walls joined by laterally extending walls and floor sections to provide a reinforcement grid which is shaped to fit in the area of the motor well and be bonded to each of an existing stringer, a bottom of a vessel and the vessel transom for reinforcing the transom of a vessel, wherein said grid comprises at least two structures, each having two spaced-apart longitudinally extending side walls, laterally extending front walls and floors coupled to said side walls and to said front walls, and an integral bridge section coupling said two structures to each other.

3. The grid as defined in claim 2 wherein said grid includes outwardly extending flanges for bonding said grid to a vessel.

4. The grid as defined in claim 3 wherein said grid is integrally molded of resin and fiberglass.

5. The grid as defined in claim 4 wherein said fiberglass has a thickness of from about 0.3 to about 0.4 inches.

6. The grid as defined in claim 5 wherein said grid is bonded to a vessel using a bonding adhesive.

7. The grid as defined in claim 6 wherein said bonding adhesive is methacrylate.

8. A vessel with a transom reinforcement grid comprising:

a hull defining a bottom of said vessel;

a transom coupled to an aft end of said hull;

a motor well located adjacent and forward of said transom;

a stringer system including longitudinally and laterally extending stringers bonded to said hull in spaced relationship to said transom; and a reinforcement grid structure having a plurality of spaced-apart, longitudinally extending walls joined by laterally extending walls and floor sections, said reinforcement grid located only in said motor well area and bonded to each of said transom of said vessel, to said stringer system, and to said hull only in the area of said motor well, wherein said reinforcing grid structure includes aft facing surfaces bonded directly to said transom for reinforcing said transom of said vessel.

9. The vessel as defined in claim 8 wherein said aft facing surfaces includes port and starboard laterally extending flanges for bonding to said transom.

10. A vessel with a transom reinforcement grid comprising:

a hull defining a bottom of said vessel;

a transom coupled to an aft end of said hull;

a motor well located adjacent and forward of said transom;

a stringer system including longitudinally and laterally extending stringers bonded to said hull in spaced relationship to said transom; and a reinforcement grid structure having a plurality of spaced-apart, longitudinally extending walls joined by laterally extending walls and floor sections, said reinforcement grid located in said motor well area and bonded to each of said transom of said vessel, to said stringer system, and to said hull for reinforcing said transom of said vessel, wherein said grid structure includes laterally extending flanges for bonding to said transom, wherein said grid comprises at least two structures, each having two spaced-apart longitudinally extending side walls, laterally extending front walls and floors coupled to said side walls and to said front wall, and an integral bridge section coupling said two structures to each other.

11. The vessel as defined in claim 10 wherein said grid includes flanges for bonding said grid to said transom of said vessel.

12. The vessel as defined claim 11 wherein said grid is integral molded of resin infused fiberglass.

13. The vessel as defined in claim 12 wherein aid fiberglass has a thickness of from about 0.3 to about 0.4 inches.

14. The vessel as defined in claim 13 wherein said grid is bonded to stringers, the hull, and the transom of a vessel using a bonding adhesive.

15. The vessel as defined in claim 14 wherein said bonding adhesive is methacrylate.

16. A reinforcement grid for installation in a vessel having a hull, a transom, a motor well located forward of the transom, and at least one stringer coupled to said hull, said grid for reinforcing the transom of the vessel to accommodate multiple engines, said grid comprising:

a plurality of spaced-apart, longitudinally extending walls integrally joined to one another by laterally extending walls and floors to define a reinforcement grid, wherein said grid is shaped to fit only within the motor well of a vessel and be coupled to an existing stringer, a bottom of a vessel only in the area of said motor well and the vessel transom for reinforcing the transom area of the vessel.

17. A reinforcement grid for installation in a vessel having a hull, a transom, a motor well located forward of the transom, and at least one stringer coupled to said hull, said grid for reinforcing the transom of the vessel to accommodate multiple engines, said grid comprising:

a plurality of spaced-apart, longitudinally extending walls integrally joined to one another by laterally extending walls and floors to define a reinforcement grid, wherein said grid is shaped to fit within the motor well of a vessel and be coupled to an existing stringer, a bottom of a vessel and the vessel transom for reinforcing the transom area of the vessel, wherein said grid is shaped in at least two structures, each having two spaced-apart longitudinally extending side walls, laterally extending front walls and floors coupled to said side walls and front walls and an integral bridge section coupling said two structures to each other.

18. The grid as defined in claim 17 wherein said grid includes outwardly extending flanges for securing said grid to said vessel.

19. The grid as defined in claim 18 wherein said grid is integrally molded of resin and fiberglass and is bonded to the stringers and the hull of a vessel using a bonding adhesive.

20. The grid as defined in claim 19 wherein said fiberglass has a thickness of from about 0.3 to about 0.4 inches.

21. The vessel as defined in claim 16 wherein said engines are at least 350 hp each.

22. The vessel as defined in claim 17 wherein said engines are at least 350 hp each.

* * * * *

UNITED STATES PATENT AND TRADEMARK OFFICE

CERTIFICATE OF CORRECTION

PATENT NO. : 8,191,495 B2
APPLICATION NO. : 12/496734
DATED : June 5, 2012
INVENTOR(S) : Christopher M. Gratz It is certified that error appears in the above-identified patent and that said Letters Patent is hereby corrected as shown below:

Column 2, line 35,

""longitudinally"," should be --"longitudinally,"--;

Column 2, line 38,

""laterally"," should be --"laterally,"--;

Column 4, lines 25-26,

"spaced-apart longitudinally" should be --spaced-apart, longitudinally--;

Column 4, line 57,

"includes" should be --include--;

Column 5, line 16,

"integral" should be --integrally--;

Column 5, line 17,

"aid" should be --said--;

Column 6, lines 15-16,

"spaced-apart longitudinally" should be --spaced-apart, longitudinally--;

Signed and Sealed this
Fourteenth Day of August, 2012

David J. Kappos
*Director of the United States Patent and Trademark Office*